US006979395B2

(12) United States Patent
Pace et al.

(10) Patent No.: US 6,979,395 B2
(45) Date of Patent: Dec. 27, 2005

(54) FUEL COMPOSITION

(75) Inventors: Stuart Pace, Oxford (GB); Alan Mark Schilowitz, Highland Park, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 204 days.

(21) Appl. No.: 10/181,857

(22) PCT Filed: Feb. 8, 2001

(86) PCT No.: PCT/US01/09792

§ 371 (c)(1),
(2), (4) Date: Oct. 18, 2002

(87) PCT Pub. No.: WO01/60955

PCT Pub. Date: Aug. 23, 2001

(65) Prior Publication Data

US 2005/0245776 A1 Nov. 3, 2005

(30) Foreign Application Priority Data

Feb. 14, 2000 (GB) ..... 0003386

(51) Int. Cl.[7] ..... C10L 1/08; C10L 1/16

(52) U.S. Cl. ..... 208/15; 585/14; 44/300

(58) Field of Search ..... 208/15, 16, 17; 585/14

(56) References Cited

U.S. PATENT DOCUMENTS

| | | | | |
|---|---|---|---|---|
| 4,463,212 | A * | 7/1984 | Imai | 585/530 |
| 6,329,561 | B1 * | 12/2001 | Webber et al. | 585/809 |
| 6,565,617 | B2 * | 5/2003 | Kalghatgi | 44/451 |
| 6,689,927 | B1 * | 2/2004 | Frame et al. | 585/510 |
| 6,767,372 | B2 * | 7/2004 | Barnes et al. | 44/300 |

FOREIGN PATENT DOCUMENTS

JP 08073870 * 3/1996

* cited by examiner

*Primary Examiner*—Ellen M. McAvoy
(74) *Attorney, Agent, or Firm*—Gary P. Katz

(57) ABSTRACT

This invention relates to a fuel composition comprising a base fuel having a final boiling point above 150° C. and an anti-foam, characterised in that the anti-foam comprises di-isobutylene in an amount greater than 2.5% by volume based on the total fuel composition. The addition of this anti-foam reduces the break-up time for any foam formed significantly.

8 Claims, No Drawings

FUEL COMPOSITION

This invention relates to fuel compositions comprising an anti-foam additive to reduce the time needed to break up any foam formation during the filling of a vehicle's fuel tank thereby enabling a more complete filling of the tank and at the same time reducing risk of spillage.

The problem of foaming of fuels due to entrainment of air during filling of fuel tanks of vehicles is well known. The problem has hitherto been mitigated by adding to the fuel antifoams which are substantially non-hydrocarbonaceous. An example of such a non-hydrocarbonaceous additive is a silicon containing polymer. Non-hydrocarbonaceous additives usually have to undergo a rigorous testing programme with respect to their compatibility with the fuel and also environmental considerations. However, if the additive is a hydrocarbon, especially a non-aromatic hydrocarbon, the issues of compatibility and environmental considerations are not as critical. JP-A-08073870 discloses gasoline compositions for two-cycle engines which contain at least 10 vol % 7–8C olefinic hydrocarbons and have a $T_{50}$ of 93–105° C., a final distillation temperature of 110–150° C. and an octane No. by the motor method of at least 95. Amongst the 11 olefins listed is mentioned 2,4,4-trimethyl-1-pentene. However, it is not clear whether these olefins are used as a blend of several. In any event, the olefins are not used as anti-foaming agents but to achieve high output and low fuel consumption and to avoid seizure even at high compression ratios. Moreover, gasoline used in two-cycle engines (ie two-stroke engines) inevitably have lubricating oils admixed therewith and hence are not as susceptible to foaming as gasolines free of such lubricating oils.

Similarly, SAE Paper 950740 describes various compounds being added to a mixture of toluene (boiling point about 110° C.) and isooctane (boiling point 99° C.) to monitor the emissions of vehicles powered therewith. One such compound added is di-isobutylene in an amount >15% by volume. The resultant mixture is unlikely to have a final boiling point above 150° C. and there is no mention of the use of di-isobutylene as an anti-foam in this document.

Similarly, JP-A-06200263 describes a composition which contains at least 65% by volume based on the total base fuel of a high boiling component with a boiling point from 80–120° C. which uses 7–8C paraffin type or olefin type hydrocarbon. The abstract of this patent makes no mention of any other base fuels or specific olefins in this range and there is no mention of any of such olefins as anti-foaming agents.

Again WO 99/49003 discloses gasoline formulations which contain inter alia at least 5% volume of saturated $C_7/C_8$ branched chain hydrocarbons. In any event, there is no mention of the use of these as anti-foaming agents.

It is an object of the present invention to formulate a fuel compositions comprising an anti-foam which is an unsaturated, non-aromatic hydrocarbon capable of reducing the break-up time to disperse such any foams formed.

Accordingly, the present invention is a fuel composition comprising a base fuel having a final boiling point greater than 150° C. and an anti-foam, characterised in that the anti-foam comprising di-isobutylene in an amount greater than 2.5% by volume based on the total fuel composition.

The base fuels may comprise mixtures of saturated, olefinic and aromatic hydrocarbons and these can be derived from straight run streams, thermally or catalytically cracked hydrocarbon feedstocks, hydrocracked petroleum fractions, catalytically reformed hydrocarbons, or synthetically produced hydrocarbon mixtures. The present invention is particularly applicable to a broad range of petroleum fuels from the light boiling gasoline (which typically boils between 50 and 200° C.) to distillate fuel (which typically boils between 150 and 400° C.). The most common distillate fuels suitable for use in the present invention as base fuels are selected from motor gasoline, kerosene and diesel fuels. The sulphur content of the base fuel is suitably less than 100 ppm by weight, is preferably less than 50 ppm by weight and more preferably less than 30 ppm by weight. Such low sulphur levels can be achieved in a number of ways. For instance, this may be achieved by well known methods such as eg, catalytic hydrodesulphurisation.

Di-isobutylene used as an anti-foam in the fuel compositions of the present invention is present in said composition in an amount greater than 2.5% by volume, suitably from 2.5% to 35% by volume, preferably 5.0% to less than 15% by volume and is more preferably present in an amount from 7.5 to less than 15% by volume of the total fuel composition. Di-isobutylene can readily be obtained by dimerisation of isobutylene. It is generally prepared from a crude mixture of olefins and usually comprises a mixture of various C8-olefin isomers but always comprises 2,4,4-trimethylpent-1-ene admixed with 2,4,4-trimethylpente-2-ene. These two isomers are suitably present in the di-isobutylene in a weight ratio of about 75% (-1-ene) to about 25% (-2-ene).

Di-isobutylene has an advantage over other non-hydrocarbonaceous anti-foams such as silicon based polymers in that di-isobutylene is substantially miscible with conventional fuels in all proportions. Di-isobutylene has the further advantage that current plants making methyl tert-butyl ether (hereafter "MTBE") from isobutylene and methanol (MTBE having more recently fallen out of favour upon environmental considerations), can be readily switched to convert the same isobutylene feedstock to di-isobutylene. Furthermore, di-isobutylene can readily make up the additional component volume to replace the MTBE used hitherto in automotive fuel component pool.

It has also been found that the-reduction in break-up time for foams formed is not due to a dilution effect of di-isobutylene. Test results show that addition of up to 2.5% by volume of di-isobutylene in the fuel did not show any reduction in the foam break-up time of the fuel tested.

The present invention is further illustrated with reference to the following Examples:

Tests were carried out in which di-isobutylene (a mixture of 3 parts 2,4,4-trimethylpent-1-ene and 1 part 2,4,4-trimethylpent-2-ene) was added to varying quantities to a distillate fuel which was susceptible to foam formation. The resultant admixture was tested in the BNPe Anti-Foam test (French Standard Test NF M 07-075) and the results obtained are shown in Table 1 below:

TABLE 1

| Blend | Fuel (ml) | DIB (ml) | DIB (%) | Foam Vol (ml) | | Mean Value | Break-up Time (seconds) | | Mean Value |
|---|---|---|---|---|---|---|---|---|---|
| 1 | 300 | 0 | 0 | 126 | 124 | 125 | 79.2 | 82.5 | 80.9 |
| 2 | 292.5 | 7.5 | 2.5 | 130 | 128 | 129 | 79.7 | 81 | 80.4 |
| 3 | 285 | 15 | 5 | 130 | 132 | 131 | 62.3 | 66.9 | 64.6 |
| 4 | 270 | 30 | 10 | 142 | 140 | 141 | 51.9 | 49.6 | 50.8 |

DIB—Di-isobutylene (a mixture of 3 parts 2,4,4-trimethylpent-1-ene and 1 part 2,4,4-trimethylpent-2-ene)

What is claimed is:

1. A fuel composition comprising a base diesel fuel and an anti-foam, characterised in that the anti-foam comprises di-isobutylene in an amount of from 7.5% to less than 15% by volume based on the total fuel composition.

2. The composition according to claim 1 wherein the base diesel fuel has a sulphur content of less than 100 ppm by weight.

3. The composition according to claim 1 wherein the base diesel fuel has a sulphur content of less than 50 ppm by weight.

4. The composition according to claim 1, 2 or 3 wherein the di-isobutylene comprises a mixture of 2,4,4-trimethylpent-1-ene and 2,4,4-trimethylpent-2-ene.

5. The composition according to claim 1, 2 or 3 wherein the di-isobutylene comprises a mixture of 2,4,4-trimethylpent-1-ene and 2,4,4-trimethylpent-2-ene in a ratio of 75% to 25% by weight.

6. A method for mitigating the foam formation tendency of diesel fuel during the filling of a fuel tank comprising adding to the diesel fuel from 7.5% to less than 15% by volume based on the total fuel composition of an anti foam comprising di-isobutylene.

7. The method of claim 6 wherein the di isobutylene comprises a mixture of 2,4,4-trimethylpent-1-ene and 2,4,4-trimethylpent-2-ene.

8. The method of claim 6 wherein he di-isobutylene comprises a mixture of 2,4,4-trimethylpent-1-ene and 2,4,4-trimethylpent-2-ene in a ratio of 75% to 25% by weight.

* * * * *